US010039330B2

(12) United States Patent
Tanaka et al.

(10) Patent No.: US 10,039,330 B2
(45) Date of Patent: Aug. 7, 2018

(54) CROTCHED EXERCISE GARMENT

(75) Inventors: Fumiko Tanaka, Kyoto (JP); Nozomu Seike, Kyoto (JP)

(73) Assignee: WACOAL CORP., Kyoto-shi, Kyoto (JP)

( * ) Notice: Subject to any disclaimer, the term of this patent is extended or adjusted under 35 U.S.C. 154(b) by 82 days.

(21) Appl. No.: 14/391,518

(22) PCT Filed: Apr. 10, 2012

(86) PCT No.: PCT/JP2012/059810
§ 371 (c)(1),
(2), (4) Date: Oct. 9, 2014

(87) PCT Pub. No.: WO2013/153624
PCT Pub. Date: Oct. 17, 2013

(65) Prior Publication Data
US 2015/0107000 A1 Apr. 23, 2015

(51) Int. Cl.
*A41D 1/06* (2006.01)
*A41D 1/08* (2018.01)
*A41D 13/00* (2006.01)

(52) U.S. Cl.
CPC ..... *A41D 1/08* (2013.01); *A41D 13/0015* (2013.01)

(58) Field of Classification Search
CPC ..... A41D 1/08; A41D 1/06; A41D 13/0015; A41D 2300/20; A41D 2300/22
(Continued)

(56) References Cited

U.S. PATENT DOCUMENTS 2,908,277 A * 10/1959 Peck ..... A41C 1/003 450/101
2,921,586 A * 1/1960 Geissmann ..... A41C 1/00 450/122
(Continued)

FOREIGN PATENT DOCUMENTS

CN 101043861 A 9/2007
CN 100377673 C 4/2008
(Continued)

OTHER PUBLICATIONS

International Preliminary Report on Patentability, International Application No. PCT/JP2012/059810 dated Oct. 14, 2014 (See A1-A2, A4-A5).
(Continued)

*Primary Examiner* — Anna Kinsaul
*Assistant Examiner* — James Heracklis
(74) *Attorney, Agent, or Firm* — Leydig Voit & Mayer

(57) ABSTRACT

According to one embodiment, an exercise garment with a crotch part includes a main body portion formed from a material having stretchability; and a tightening portion having higher tightening force than the main body portion, in which the tightening portion includes a pair of right and left first tightening portions respectively covering an approximately triangular region formed by the upper part of the hip, the lateral side of the lumbar region, and the vicinity of a position corresponding to the greater trochanter as the apex of the triangular region, in the right and left sides of the wearer. The first tightening portions include plural partitioned tightening portions extending in the vertical direction and adjoining in the width direction. The partitioned tightening portions are formed such that the directions of high stretchability in the respective partitioned tightening portions approach closer to one another toward the lower side.

8 Claims, 18 Drawing Sheets

(58) Field of Classification Search
USPC ..... 2/227, 69, 79, 239, 78.3, 228, 240
See application file for complete search history.

(56) References Cited

U.S. PATENT DOCUMENTS 2,958,327 A * 11/1960 Geissmann ..... A41C 1/00 450/101
3,068,871 A * 12/1962 Rapp ..... A41D 1/06 450/95
3,338,776 A * 8/1967 Blair ..... A41C 1/02 2/407
3,513,853 A * 5/1970 Marino ..... A41C 1/003 450/104
3,835,866 A * 9/1974 Brooks ..... A41C 1/003 450/123
3,877,439 A * 4/1975 Locascio ..... A41C 1/02 450/123
4,538,615 A * 9/1985 Pundyk ..... A41C 1/003 450/131
4,625,336 A * 12/1986 Derderian ..... A41D 1/08 2/227
4,862,523 A * 9/1989 Lipov ..... A41B 11/14 2/409
5,109,546 A * 5/1992 Dicker ..... A41D 13/0015 2/227
5,201,074 A * 4/1993 Dicker ..... A41D 13/0015 2/227
5,271,101 A * 12/1993 Speth ..... A41D 1/084 2/214
5,367,708 A * 11/1994 Fujimoto ..... A41D 13/0015 2/22
5,787,732 A * 8/1998 Perron ..... D04B 1/243 2/401
5,888,118 A * 3/1999 Kishi ..... A41C 1/003 2/243.1
6,047,406 A * 4/2000 Dicker ..... A41D 13/0015 2/115
6,186,970 B1 * 2/2001 Fujii ..... A41D 13/0015 2/22
6,189,155 B1 * 2/2001 Boulanger ..... A41B 11/14 2/409
6,430,752 B1 * 8/2002 Bay ..... A41C 1/003 2/228
6,430,753 B2 * 8/2002 Duran ..... A41B 11/003 2/239
6,874,337 B2 * 4/2005 Uno ..... A41D 1/08 2/401
D513,830 S * 1/2006 Ota ..... D2/731
7,074,204 B2 * 7/2006 Fujii ..... A41C 1/003 128/96.1
7,087,032 B1 * 8/2006 Ikeda ..... A61F 5/03 128/891
7,229,390 B2 * 6/2007 Fujii ..... A41D 1/08 2/2.16
7,509,822 B2 * 3/2009 Ishida ..... A41C 1/003 2/401
7,516,498 B2 * 4/2009 Torry ..... 2/69
7,526,929 B2 * 5/2009 Takamoto ..... A41B 11/14 66/177
7,559,093 B2 * 7/2009 Sudo ..... A41C 1/003 2/227
7,631,366 B2 * 12/2009 Oyama ..... A41C 1/003 2/228
7,730,552 B2 6/2010 Ota et al.
7,748,056 B2 * 7/2010 Mickle ..... A41D 13/0512 2/115
D620,686 S * 8/2010 Morii ..... D2/742
D632,461 S * 2/2011 Morii ..... D2/742
7,886,367 B2 * 2/2011 Chapuis ..... A41D 13/0015 2/22
7,945,970 B2 * 5/2011 Belluye ..... A41D 1/084 2/227
8,296,864 B2 * 10/2012 Torry ..... A41D 1/08 2/69
D681,916 S * 5/2013 Tanaka ..... D2/738
8,533,864 B1 * 9/2013 Kostrzewski ..... A41D 13/0015 2/69
D698,518 S * 2/2014 Tanaka ..... D2/738
D703,920 S * 5/2014 Tanaka ..... D2/738
8,784,351 B2 * 7/2014 Dumpson ..... A41C 1/02 2/401
2004/0016043 A1 * 1/2004 Uno ..... A41B 9/001 2/400
2004/0107479 A1 * 6/2004 Dicker ..... A41D 13/0015 2/227
2004/0111781 A1 * 6/2004 Miyake ..... A41C 1/003 2/69
2004/0234478 A1 11/2004 Clapp et al.
2004/0255358 A1 * 12/2004 Ota ..... A41D 13/0015 2/69
2005/0193461 A1 * 9/2005 Caillibotte ..... A41D 13/0015 2/69
2005/0229293 A1 * 10/2005 Miller ..... A41B 9/02 2/403
2005/0239370 A1 * 10/2005 Oyama ..... A41C 1/003 450/99
2006/0074365 A1 * 4/2006 Brown ..... A61F 5/0193 602/24
2006/0130215 A1 * 6/2006 Torry ..... A41D 1/08 2/227
2008/0083055 A1 * 4/2008 Onda ..... A41D 13/0015 2/455
2008/0120757 A1 * 5/2008 Nakazawa ..... A41D 13/0015 2/22
2008/0194181 A1 * 8/2008 Sudo ..... A41C 1/003 450/123
2009/0025115 A1 * 1/2009 Duffy ..... A41D 13/0015 2/69
2010/0043123 A1 * 2/2010 Goodhand ..... A41D 13/0015 2/228
2010/0088803 A1 * 4/2010 Orloff ..... A41D 13/0015 2/228
2010/0107299 A1 5/2010 Ota et al.
2010/0162466 A1 * 7/2010 Fukuyo ..... A41D 1/08 2/227
2010/0275349 A1 * 11/2010 Wilson, II ..... A41B 9/12 2/466
2012/0210487 A1 * 8/2012 Albin ..... A41D 1/08 2/69
2013/0160189 A1 * 6/2013 Yang ..... A63B 21/0552 2/227
2013/0167285 A1 * 7/2013 Decker ..... A41D 13/0002 2/69
2013/0254971 A1 * 10/2013 Galluzzo ..... A41D 1/00 2/115
2013/0298306 A1 * 11/2013 Turner ..... A41D 1/08 2/115
2013/0312157 A1 * 11/2013 Freddi ..... A41D 1/06 2/227
2014/0075656 A1 * 3/2014 Chang ..... A41D 13/0015 2/455
2015/0107000 A1 * 4/2015 Tanaka ..... A41D 1/08 2/227

FOREIGN PATENT DOCUMENTS

CN 101754698 A 6/2010
EP 1 618 804 A1 1/2006
JP 2001-214303 A 8/2001
JP 2006-322121 A 11/2006
JP 2008-274493 A 11/2008
JP 2011-032599 2/2011
WO WO 2004/091328 A1 10/2004
WO WO 2006043476 * 4/2006 ..... A41D 13/00
WO WO 2006080190 * 8/2006 ..... A41D 13/00

(56) References Cited

FOREIGN PATENT DOCUMENTS

| | | | | |
|---|---|---|---|---|
| WO | WO 2009050769 | * | 4/2009 | ..... A41D 13/0015 |
| WO | WO 2013153624 | * | 11/2013 | ..... A41D 13/0015 |

OTHER PUBLICATIONS

Internatinoal Search Report, International Application No. PCT/JP2012/059810 dated Jun. 26, 2012.
European Patent Office, Extended European Search Report in European Application No. 12874068.5, dated Dec. 22, 2015.

* cited by examiner (a)

(b)

(a)

(b)

(a)

(b)

CROTCHED EXERCISE GARMENT

TECHNICAL FIELD

The present invention relates to an exercise garment with a crotch part that supports exercise of the legs of a wearer.

BACKGROUND ART

There have been conventionally known garments for supporting the muscle activity of the legs of a wearer, as described in Patent Literatures 1 and 2 mentioned below. The below-mentioned Patent Literature 1 describes a legwear in which inner patterns corresponding to the leg muscles such as the gluteus maximus muscle are sewed up. In this legwear, the respective patterns are allowed to stretch vertically. Also, the below-mentioned Patent Literature 2 describes a wet suit provided with strong tightening force portions having a strong tightening force. In this wet suit, strong tightening force portions are disposed along the leg muscles. For example, a strong tightening force portion disposed from the tensor fasciae latae muscle toward the abdominal region and the lumbar region is described.

CITATION LIST

Patent Literature

Patent Literature 1: Japanese Patent Application Laid-Open No. 2008-274493

Patent Literature 2: Japanese Patent Application Laid-Open No. 2011-32599

SUMMARY OF INVENTION

Technical Problem

In the garments of the prior art described above, muscle activity and supportiveness for joint regions are assisted by stretchable materials having tightening force. Thereby, the load imposed on the legs of the wearer is reduced, and enhancement of the exercise performance is promoted.

Here, as a specific condition of exercise, movement in a transverse direction or an oblique direction may be considered. Particularly, when a wearer moves in an instantaneous or sudden manner while moving in a transverse direction or an oblique direction, a large strain is added to the legs of the wearer. Specific examples of the movement include a movement of suddenly stopping while moving in a transverse direction or an oblique direction, a movement of suddenly twisting the body, and a movement of suddenly starting to run. Such movements can occur frequently in, for example, sports games such as baseball, volleyball and basketball.

However, in the prior art technologies, support of the legs in relation to the movement in a transverse direction or an oblique direction is not taken into consideration. Therefore, when a wearer moves in an instantaneous or sudden manner in a transverse direction or an oblique direction, excessive loads may be imposed on the knees and the like, and thus there is a possibility of causing injuries. As such, it has been difficult to sufficiently support the exercise of the legs in relation to the movement in a transverse direction or an oblique direction.

An object of the present invention is to provide an exercise garment with a crotch part capable of supporting the exercise of the legs sufficiently in relation to the movement in a transverse direction or an oblique direction.

Solution to Problem

The exercise garment with a crotch part according to an aspect of the present invention is an exercise garment with a crotch part that covers, at least a part of the lower body of a wearer, and includes a main body portion formed from a material having stretchability; and a tightening portion having higher tightening force than the main body portion, characterized in that the tightening portion includes a pair of right and left first tightening portions respectively covering an approximately triangular region formed by the upper part of the hip, the lateral side of the lumbar region, and the vicinity of a position corresponding to the greater trochanter as the vertex of the triangular region, on the right side and the left side of the wearer; the first tightening portions each have plural partitioned tightening portions extending in the vertical direction and adjoining in the width direction; and the partitioned tightening portions are formed such that the directions of high stretchability in the respective partitioned tightening portions approach closer to one another toward the lower side.

According to this exercise garment with a crotch part, the tightening portion includes a pair of right and left first tightening portions that cover an approximately triangular region formed by the upper part of the hip, the lateral side of the lumbar region, and the vicinity of a position corresponding to the greater trochanter as the vertex of the triangular region, on the right side and the left side of the wearer. The approximately triangular region formed by the upper part of the hip, the lateral side of the lumbar region, and the vicinity of a position corresponding to the greater trochanter, corresponds to the position of the gluteus medius muscle of the wearer. This gluteus medius muscle is a fan-shaped muscle extending from the ilium to the greater trochanter, and constitutes the basis of hip joints. Here, the first tightening portions have plural partitioned tightening portions extending in the vertical direction and adjoining in the width direction, and these partitioned tightening portions are formed such that the directions of high stretchability in the respective partitioned tightening portions approach closer to one another toward the lower side. Therefore, the partitioned tightening portions respectively cover the anterior side and the posterior side of the gluteus medius muscle. Furthermore, since the directions of high stretchability of the partitioned tightening portions respectively conform to the muscle fiber directions of the front side and the back side of the gluteus medius muscle that forms a fan shape, the partitioned tightening portions can reliably support the gluteus medius muscle. As such, the exercise of the legs in relation to the movement in a transverse direction and in an oblique direction can be sufficiently supported by reliably supporting the gluteus medius muscle that constitutes the basis of the movement of hip joints.

Furthermore, according to an embodiment, in the waist region, a width of a front side region in which the first tightening portions are not formed may be larger than a width of a back side region in which the first tightening portions are not formed. The gluteus medius muscle is located closer to the back side than the side of the body. Therefore, the first tightening portions can be disposed at positions appropriate for supporting the gluteus medius muscle.

Furthermore, according to an embodiment, in the waist portion, the width of the front side region in which the first tightening portions are not formed may be two times or more and five times or less the width of the back side region in which the first tightening portions are not formed. In this case, since the width of the front side region in which the first tightening portions are not formed is larger, the sensation of pressure against the abdominal region can be reduced.

Furthermore, according to another embodiment, the tightening portion may have a second tightening portion extending from a front part of the first tightening portion to the inner side of the knee region of the wearer via the anterior side of the femoral region of the wearer. In this case, since the second tightening portion is disposed in a region corresponding to the sartorius muscle, the second tightening portion can adequately support the legs in relation to the movement of suddenly stopping while moving in a transverse direction or an oblique direction. Therefore, the impact exerted on the legs can be alleviated.

Also, according to another embodiment, the tightening portion may have a third tightening portion extending from a lower part of the first tightening portion to the inner side of the knee region of the wearer via the posterior side of the femoral region of the wearer. In this case, since the third tightening portion is disposed in a region corresponding to the hamstrings, the third tightening portion can adequately support the legs in relation to the movement of suddenly starting to run. Therefore, the impact exerted on the legs can be alleviated.

Advantageous Effects of Invention

According to the present invention, the exercise of the legs in relation to the movement in a transverse direction or an oblique direction can be sufficiently supported.

BRIEF DESCRIPTION OF DRAWINGS

FIG. 9(*b*) is a diagram illustrating the skeletal structure group of the human body lower limb region and the gluteus medius muscle viewed from the left side.

DESCRIPTION OF EMBODIMENTS

Hereinafter, embodiments of the exercise garments with crotch parts according to the present invention will be explained with reference to the drawings.

Figure 1:
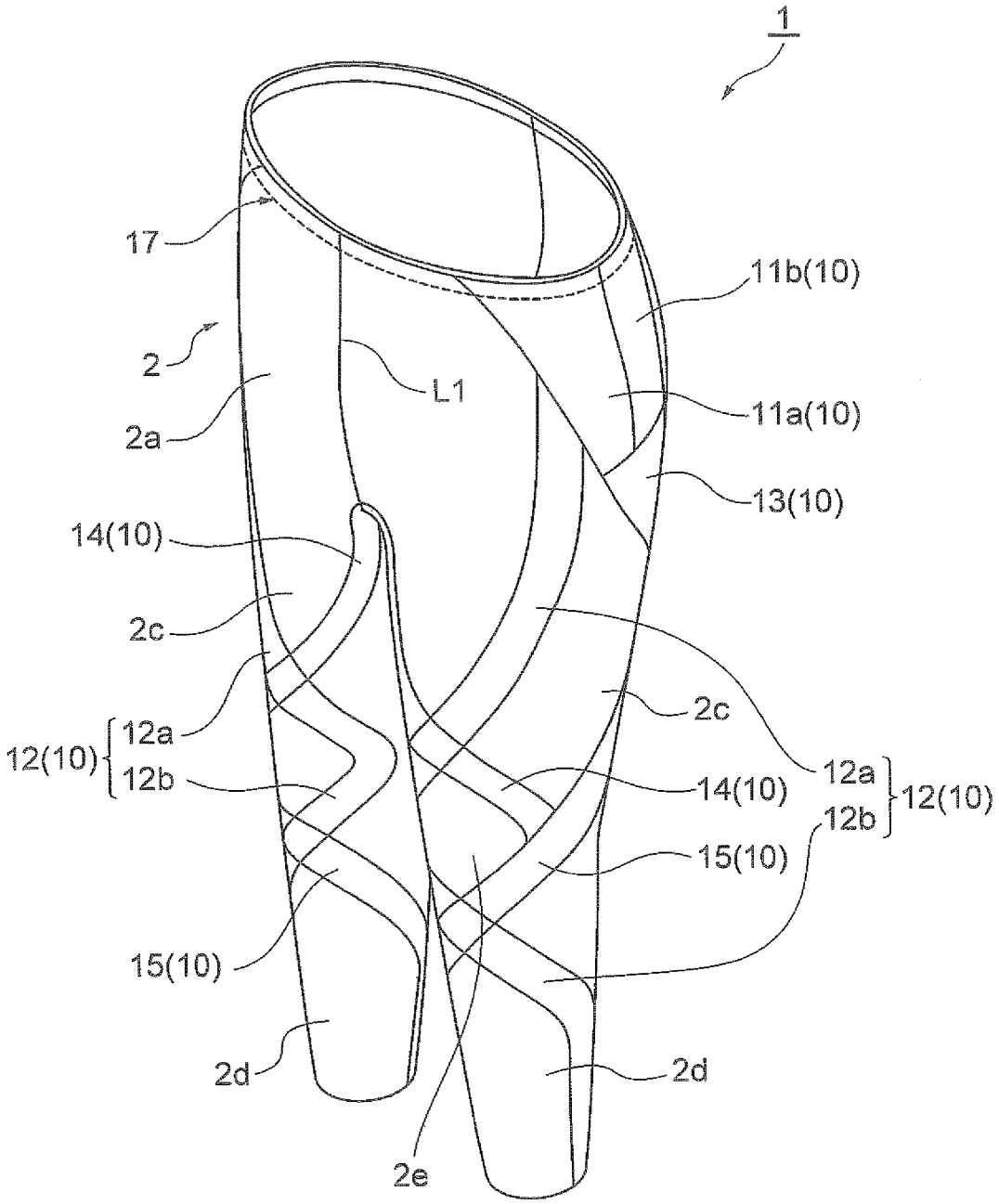
FIG. 1 is a perspective view diagram obtained by viewing an exercise garment with a crotch part according to a first embodiment from the above.
Figure 2:
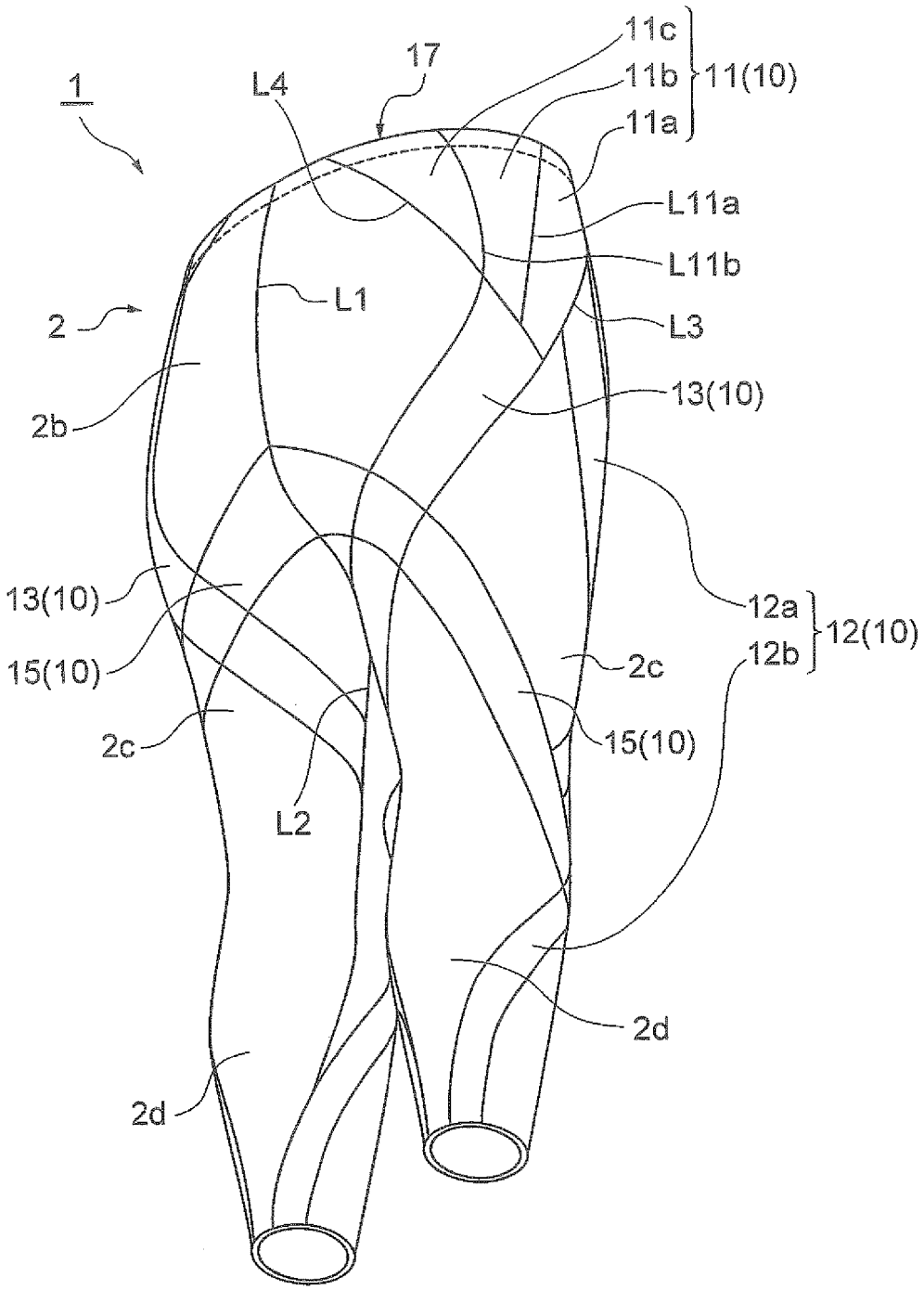
FIG. 2 is a perspective view diagram obtained by viewing the exercise garment with a crotch part illustrated in FIG. 1 from the below.

As illustrated in FIG. 1 and FIG. 2, the exercise garment with a crotch part 1 according to a first embodiment is a sport tights that covers at least a part of the lower body of a wearer and supports the exercise of the legs of the wearer. The exercise garment with a crotch part 1 is a long type sport tights covering up to at least the knees of the wearer. The exercise garment with a crotch part 1 supports the exercise of the legs in relation to the movement in a transverse direction or an oblique direction of a wearer who performs sports. The exercise garment with a crotch part 1 is worn by, for example, a player of soccer, baseball, volleyball or basketball. The exercise garment with a crotch part 1 is not intended to be limited for vigorous exercise such as sports, and may also be applied to inner wears worn daily (for example, girdles and panties).

The exercise garment with a crotch part 1 includes a main body portion 2 that sticks to the body of a wearer extending from the lumbar region to the femoral region and the knee, and tightening portions 10 sewed up to the main body portion 2. The main body portion 2 is formed by a material having stretchability. The main body portion 2 is formed from a two-way material having high followability in a longitudinal direction and a transverse direction. Regarding the material that forms the main body portion 2, for example, Two-Way Tricot having a polyester yarn blend ratio of 70% and a polyurethane yarn blend ratio of 30% can be used. When a material which stretches significantly in a longitudinal direction and in a transverse direction and has high followability is employed in the main body portion 2, even if the support lines (tightening portions) are increased, easy movability is secured for the wearer.

The right and left sides of the main body portion 2 are seamed to each other by a seam line L1 that passes through the central area extending from the front part 2*a* to the rear region 2*b*. The right and left leg regions 2*c* and the right and left hem regions 2*d* are formed by a seam line L2 that intersects the seam line L1 at the center of the crotch region. In a waist portion 17, for example, a rubber-incorporated inside tape is passed therethrough, and the sense of fitting to the waist at the time of wearing can be increased.

The tightening portion 10 is a supportive region formed by a material having tightening force. Regarding the material that forms the tightening portion 10, for example, Satin Powernet having a nylon yarn blend ratio of 79% and a polyurethane yarn blend ratio of 21% is used. The tightening portion 10 has higher tightening force than the main body portion 2. The tightening portion 10 supports the muscles and skeleton of the wearer corresponding to the allocated areas of the tightening portion 10, as a result of the action of the tightening force of the tightening portion.

The tightening portion 10 has a pair of right and left first tightening portions 11 and 11 respectively covering an approximately triangular region formed by the upper part of the hip, the lateral side of the lumbar region, and the vicinity of a position corresponding to the greater trochanter, on the right and left sides of the wearer. Furthermore, the tightening portion 10 includes a pair of right and left second tightening portions 12 and 12, a pair of right and left third tightening portions 13 and 13, a pair of right and left fourth tightening portions 14 and 14, and a pair of right and left fifth tightening portions 15 and 15, which are formed into a band shape in the lower part of the first tightening portions 11, and stretches along the right and left leg regions of the wearer.

Figure 9:
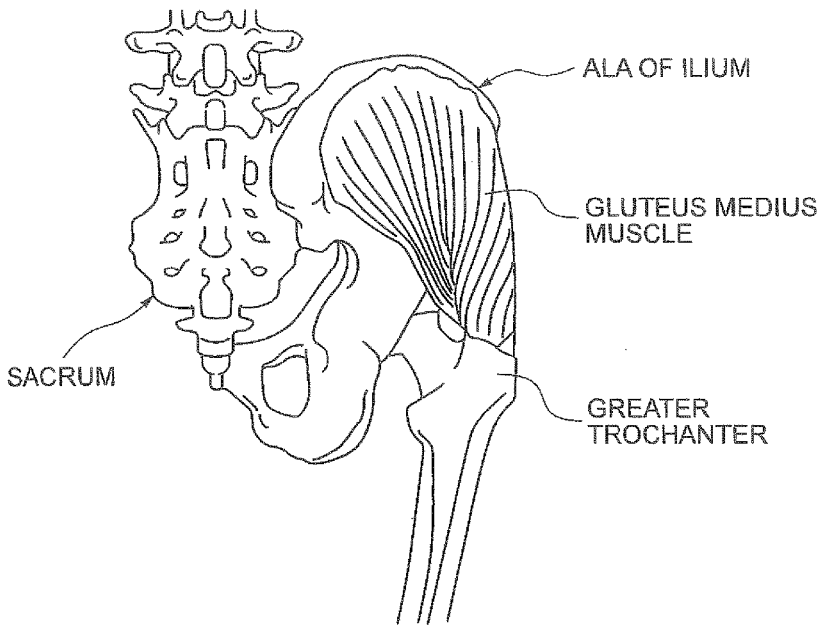
FIG. 9(*a*) is a diagram illustrating the skeletal structure group of the human body lower limb region and the gluteus medius muscle viewed from the back side.
Figure 9:
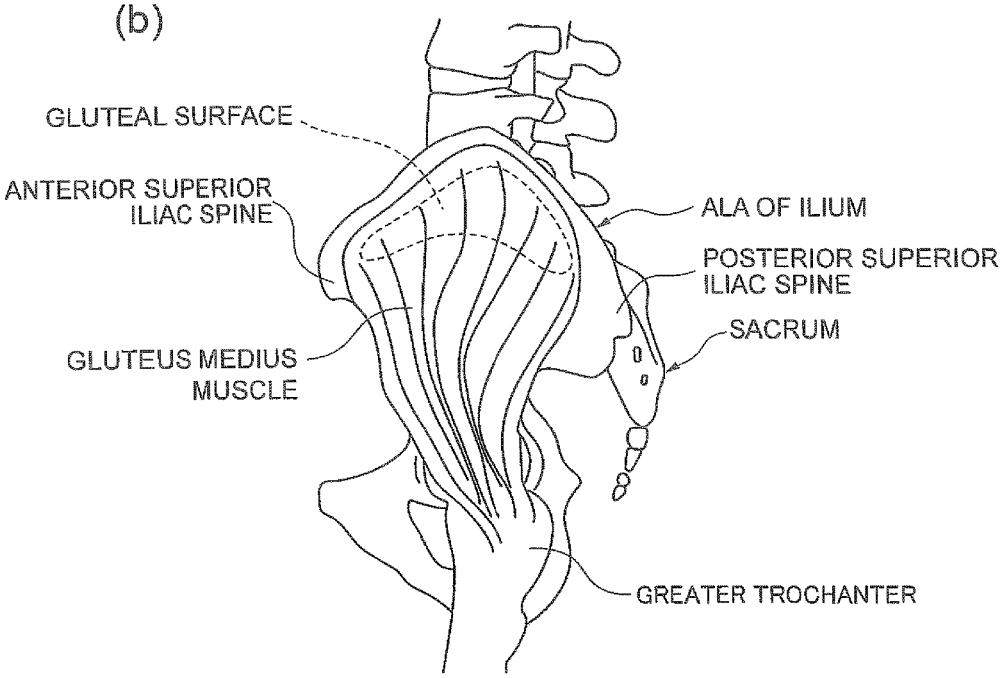

FIG. 9(*a*) is a diagram illustrating the skeletal structure group of the human body lower limb region and the gluteus medius muscles viewed from the back side, and FIG. 9(*b*) is a diagram illustrating the skeletal structure group of the human body lower limb region and the gluteus medius muscles viewed from the left side. As illustrated in FIGS. 9(*a*) and 9(*b*), the pelvic girdle of the human body lower limb region is configured to include the pelvis composed of coxa and sacrum, and hip joints. The greater trochanter is located in the upper part of the thighbone, and is protruded from a hip joint toward the outside. Mobility of the pelvic girdle involves many muscles such as the tensor fasciae latae muscle, the gluteus maximum muscle, the gluteus medius muscle, and the gluteus minimus muscle.

In the exercise garment with a crotch part 1 of the present embodiment, attention is paid mainly to the gluteus medius muscle. The gluteus medius muscle is primarily located in the deep part of the gluteus maximus muscle, and is positioned so as to join the gluteal surface of the ala of the ilium and the outer surface of the greater trochanter. The greater trochanter is formed so as to extend in a fan shape from the gluteus maximus muscle toward the ala of the ilium. The front part of the gluteus medius muscle (shown on the left side of FIG. 9(*b*)) is a muscle working for bending and internal rotation, and functions when, for example, the leg is twisted inward (at the time of internal rotation). The back part of the gluteus medius muscle (shown on the right side of FIG. 9(*b*)) is a muscle working for spreading and external rotation, and functions when, for example, the leg is twisted outward (at het time of external rotation).

The first tightening portion 11 is a part that supports the gluteus medius muscle of a wearer. The first tightening portion 11 is formed at a position corresponding to the gluteus medius of the wearer. Here, the "upper part of the hip" described above is near the position X corresponding to a slightly anterior side of the posterior superior iliac spine (see FIG. 9(*b*)), and the "lateral side of the lumbar region" is near the position Y corresponding to a slightly posterior side of the anterior superior iliac spine (see FIG. 9(*b*)) (see FIG. 5). The approximately triangular region formed by the upper part of the hip (near the position X), the lateral side of the lumbar region (near the position Y), and the vicinity of the position Z corresponding to the greater trochanter as the apex, corresponds to the position of the gluteus medius muscle of the wearer. The first tightening portion 11 is formed to extend from the position of the ala of the ilium of the wearer to the vicinity of the position Z of the greater trochanter, and covers the gluteus medius muscle with the gluteus maximum muscle disposed therebetween. The first tightening portion 11 forms an approximate fan shape having a narrower width toward the lower side (see FIG. 5).

Figure 3:
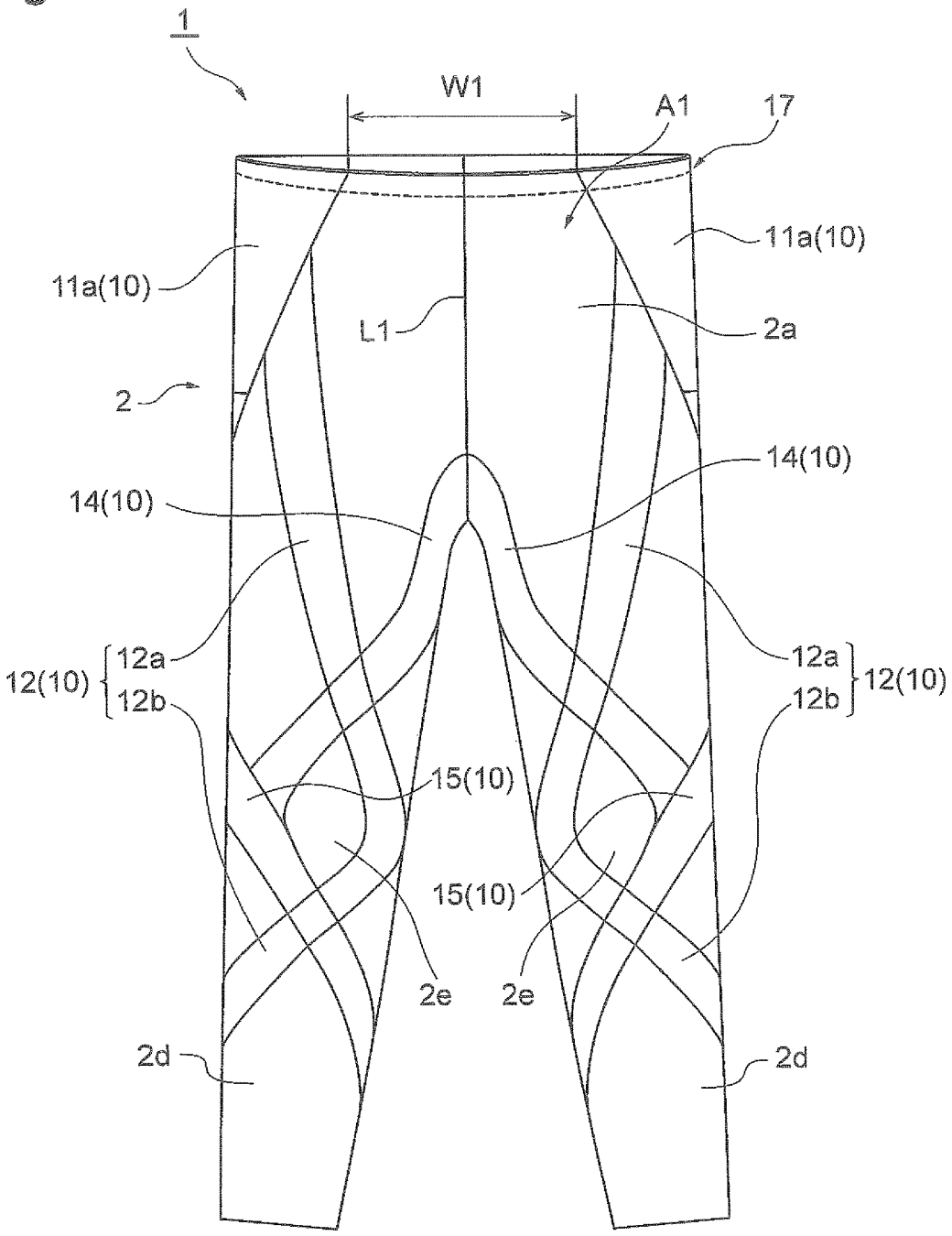
FIG. 3 is a front view diagram of the state in which the exercise garment with a crotch part illustrated in FIG. 1 is placed flat.
Figure 5:
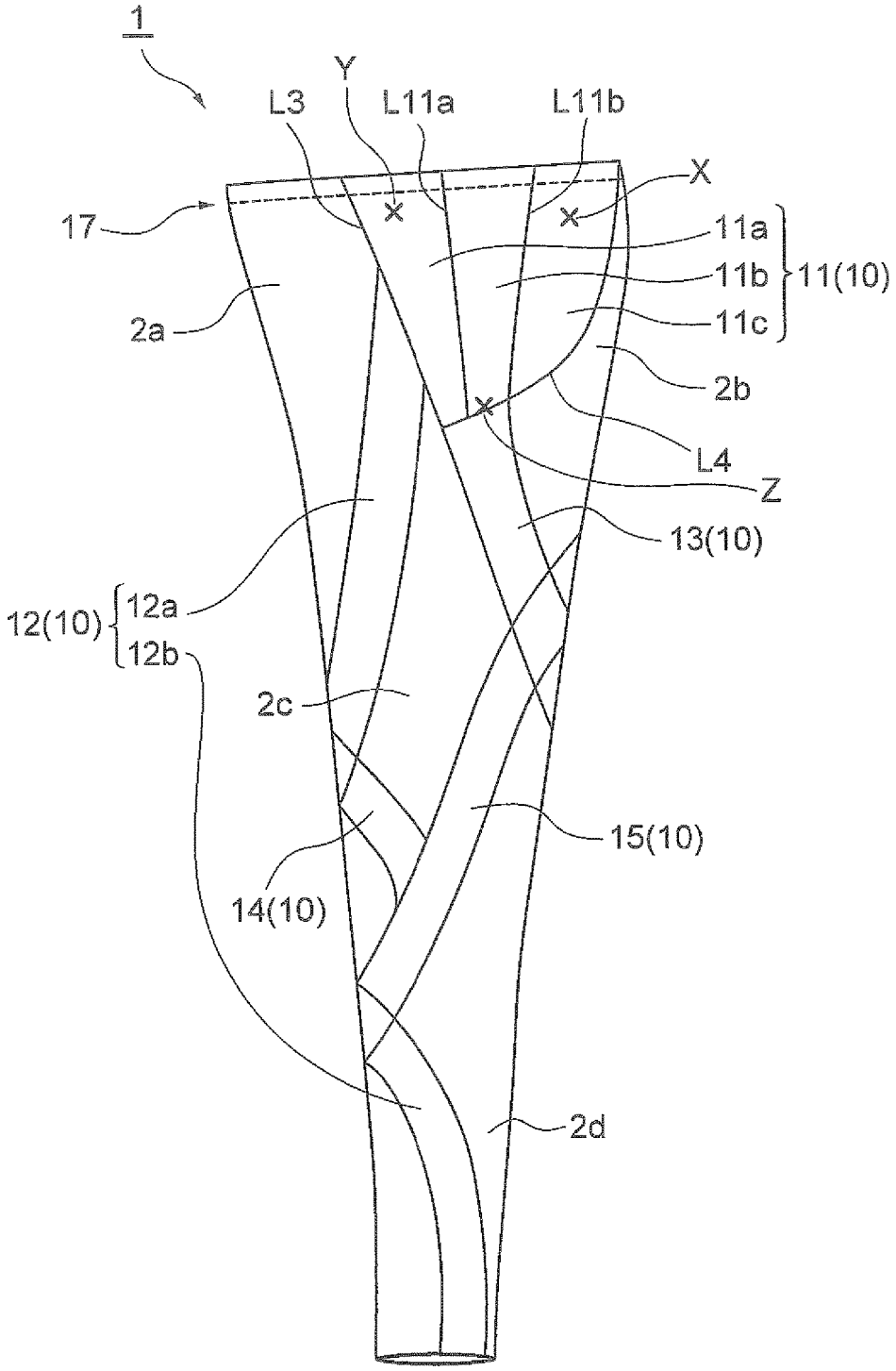
FIG. 5 is a diagram of the state in which the exercise garment with a crotch part illustrated in FIG. 1 is placed flat with the right side facing downward.

The second tightening portion 12 is a part that supports the sartorius muscle of the wearer (see FIG. 1, FIG. 3, and FIG. 5). The sartorius muscle is positioned so as to join the anterior superior iliac spine of the ilium and the inner side of the tibial tuberosity, and functions at the time of external rotation of a hip joint. The second tightening portion 12 is composed of a first line 12*a* extending from the front part of the first tightening portion 11 to the inner side of a knee of the wearer via the anterior side of the femoral region of the wearer; and a second line 12*b* extending from the inner side of a knee to the outer side of the calf region via the anterior side of the shin region. The first line 12*a* of the second tightening portion 12 is formed at a position corresponding to the sartorius muscle of the wearer. The upper end of the first line 12*a* is sewed up to the front part of the first tightening portion 11. Meanwhile, the upper end of the first line 12*a* is not limited to be sewed up to the front part of the first tightening portion 11, and there may be provided a spacing between the upper end of the first line 12*a* and the first tightening portion 11.

Figure 4:
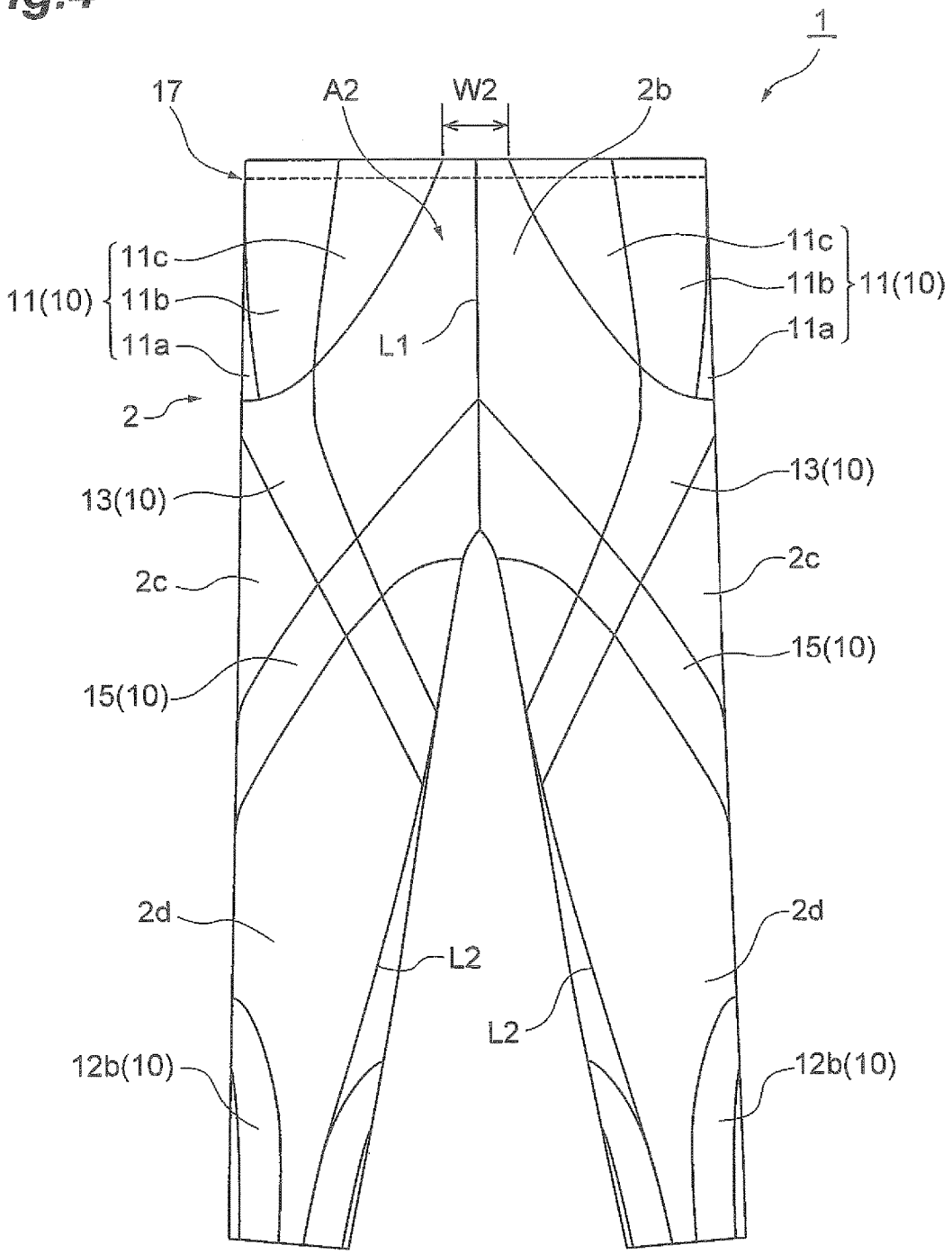
FIG. 4 is a rear view diagram of the state in which the exercise garment with a crotch part illustrated in FIG. 1 is placed flat.

The third tightening portion 13 is a part that supports the hamstrings of the wearer (see FIG. 2, FIG. 4, and FIG. 5). The term hamstrings is a collective name for the biceps femoris muscle, semitendinous muscles, and semimembranous muscles. Hamstrings are located in the rear part of the thigh, and function at the time of starting to run or at the time of accelerating during running. The third tightening portion 13 extends from the lower part of the first tightening portion 11 to the inner side of a knee of the wearer via the posterior side of the femoral region of the wearer. The upper end of the third tightening portion 13 is sewed up to the lower part of the first tightening portion 11. Meanwhile, the upper end of the third tightening portion 13 is not limited to be sewed up to the lower part of the first tightening portion 11, and a spacing may be provided between the upper end of the third tightening portion 13 and the lower part of the first tightening portion 11.

The fourth tightening portion 14 is a part that supports the upper part of the adductor muscle of the wearer (see FIG. 1 and FIG. 3). The fourth tightening portion 14 extends from the vicinity of the center of the crotch at which the seam line L1 and the seam line L2 intersect, to the lower part along the adductor muscle, and further extends to the outer side of a knee of the wearer via the anterior side of the femoral region of the wearer. The lower end of the fourth tightening portion 14 is sewed up to the fifth tightening portion 15 at a position on the outer side of a knee of the wearer.

The fifth tightening portion 15 is a part that supports the outer side of a knee of the wearer and the inner side of a calf (see FIG. 1 to FIG. 5). The fifth tightening portion 15 extends from the vicinity of the center of the crotch at which the seam line L1 and the seam line L2 intersect, to the outer side of a knee of the wearer via the posterior side of the femoral region of the wearer, and further extends to the inner side of the calf region via the anterior side of the shin region. The fifth tightening portion 15 and the third tightening portion 13 intersect each other on the posterior side of the femoral region of the wearer (see FIG. 2, FIG. 4, and FIG. 5).

The first line 12*a* and the second line 12*b* of the second tightening portion 12, the fourth tightening portion 14, and the fifth tightening portion 15 pass around the kneecap. The first line 12*a* and the fourth tightening portion 14 intersect each other on the upper side of the kneecap, and the second line 12*b* and the fifth tightening portion 15 intersect each other on the lower side of the kneecap. At the position corresponding to the kneecap, a diamond-shaped hole 2*e* is formed, which is an area at which the main body portion 2 is exposed (see FIG. 1 and FIG. 3).

Hereinafter, the first tightening portion 11 will be described in more detail. As illustrated in FIG. 2, FIG. 4 and FIG. 5, the first tightening portion 11 is formed near the posterior part (close to the back surface) based on the anterior-posterior direction. The area of the front side region A1 (see FIG. 3) in which the first tightening portion 11 is not formed is larger than the area of the back side region A2 (see FIG. 4) in which the first tightening portion 11 is not formed. In the waist portion 17, the width W1 of the front side region A1 (see FIG. 3) in which the first tightening portion 11 is not formed is larger than the width W2 of the back side region A2 (see FIG. 4) in which the first tightening portion 11 is not formed. The width W1 of the region A1 in the waist portion 17 is 2 times or more and 5 times or less the width W2 of the region A2 in the waist portion 17.

As such, the first tightening portion 11 is formed so as to avoid the position corresponding to the abdominal region of the wearer. Meanwhile, formed at the position corresponding to the abdominal region of the wearer is an abdominal region tightening portion 18. The abdominal region tightening portion 18 is seamed to the back surface side of the front part 2*a*, and has high stretchability in the horizontal direction (see FIG. 6 and FIG. 8). The elongation recovery force of the abdominal region tightening portion 18 is smaller than the elongation recovery force of other tightening portions 11 to 15. By lowering the elongation recovery force of the abdominal region tightening portion 18, it makes the wearer feel less pressure in the abdominal region. Meanwhile, line L10 in FIG. 8 represents the line of the crotch when the garment is placed flat.

Furthermore, as illustrated in FIG. 2 and FIG. 5, the first tightening portion 11 includes plural partitioned tightening portions 11*a*, 11*b* and 11*c* extending in the vertical direction and adjoining in the width direction (horizontal direction of FIG. 5). The partitioned tightening portion 11*a* on the anterior side forms a quadrilateral shape that is vertically long and tapering downward, and is sewed up to the front part 2*a* by a seam line L3. The partitioned tightening portion 11*b* at the center forms a quadrilateral shape that is vertically long and tapering downward. The partitioned tightening portion 11*c* on the posterior side forms a vertically long shape, and is sewed to the rear region 2*b* by a seam line L4.

The partitioned tightening portion 11*a* and the partitioned tightening portion 11*b* are sewed up by a seam line L11*a* extending in the vertical direction, and are adjoining through the seam line L11*a*. The partitioned tightening portion 11*b* and partitioned tightening portion 11*c* are sewed up by a seam line L11*b*extending in the vertical direction, and are adjoining through the seam line L11*b*. A seam line L4 that seams the partitioned tightening portion 11*c* and the rear region 2*b* extends, while forming a smooth bending line, to the lower edges of the partitioned tightening portion 11*a* and the partitioned tightening portion 11*b*. The partitioned tightening portion 11*a* and the partitioned tightening portion 11*b* are respectively sewed up to the upper end of the third partitioned tightening portion 13 by this seam line L4. The width of the upper edge of the third tightening portion 13 is identical to the width combining the lower edge of the partitioned tightening portion 11*a* and the lower edge of the partitioned tightening portion 11*b*.

Figure 6:
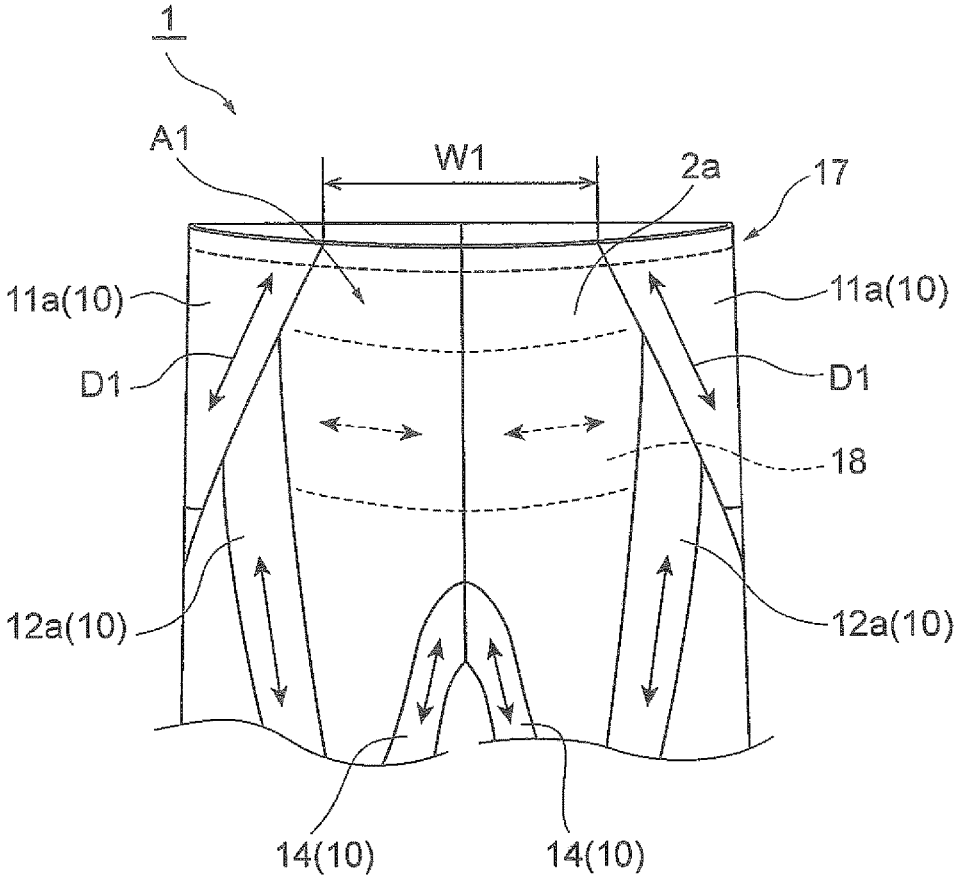
FIG. 6 is a front view diagram corresponding to FIG. 3, and is a diagram illustrating the directions of high stretchability.
Figure 7:
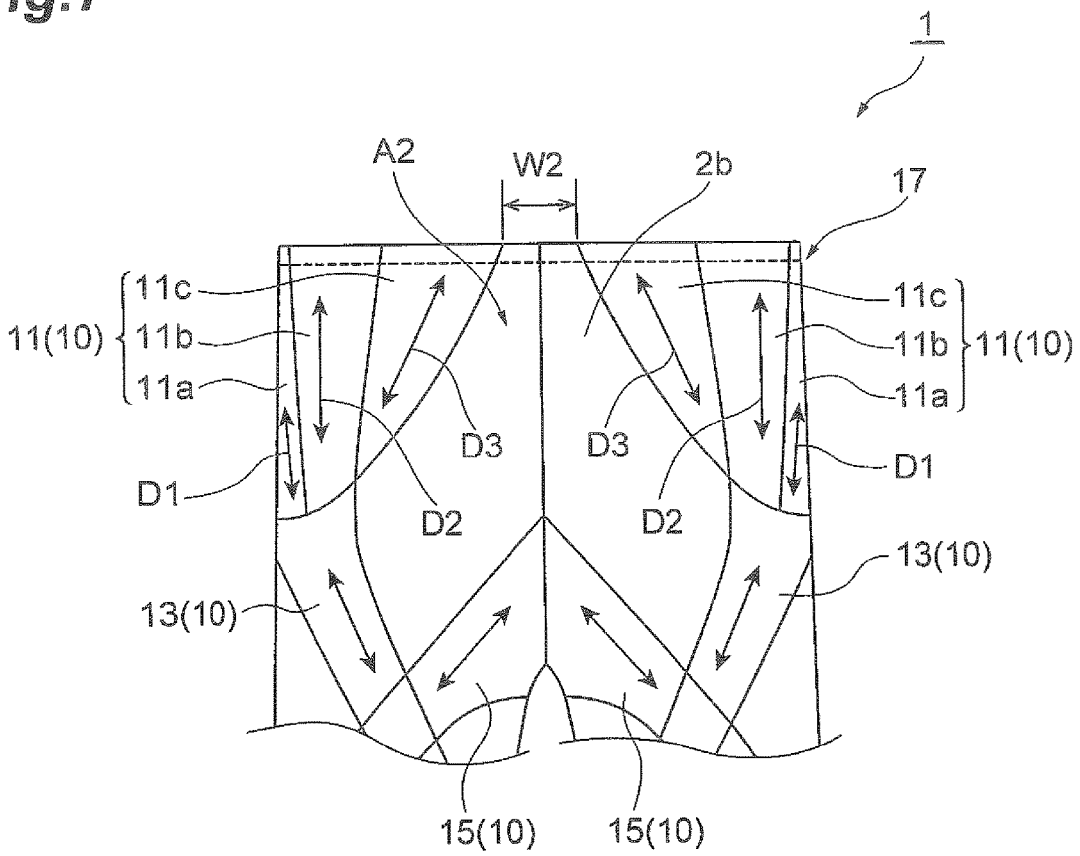
FIG. 7 is a rear view diagram corresponding to FIG. 4, and is a diagram illustrating the directions of high stretchability.
Figure 8:
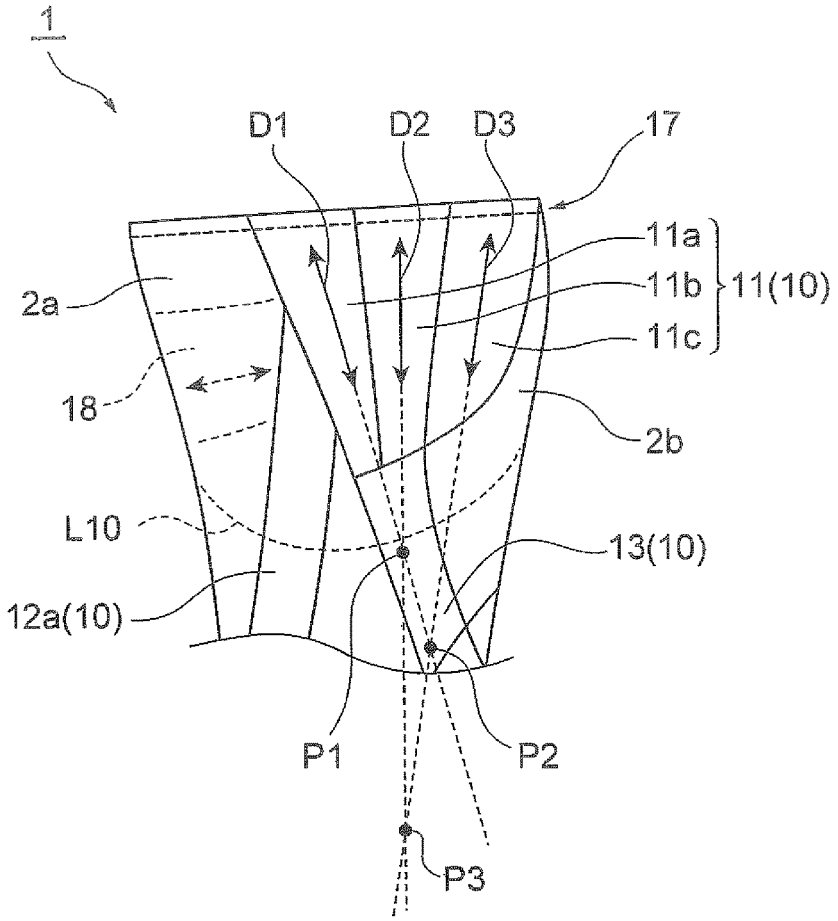
FIG. 8 is a diagram corresponding to FIG. 5, and is a diagram illustrating the directions of high stretchability.

In regard to the exercise garment with a crotch part 1 of the present embodiment, as illustrated in FIG. 6 to FIG. 8, the first tightening portion 11 is formed such that the directions of high stretchability D1, D2 and D3 in the partitioned tightening portions 11*a*, 11*b* and 11*c*, respectively, approach closer to one another toward the lower side. The directions of high stretchability D1, D2 and D3 in the partitioned tightening portions 11*a*, 11*b* and 11*c*, respectively, are non-parallel to one another, and the distances between the directions D1, D2 and D3 become narrower toward the lower side. In other words, the directions of high stretchability D1, D2 and D3 in the partitioned tightening portions 11*a*, 11*b* and 11*c*, respectively, intersect one another at the lower part of the first tightening portion (see the intersection points P1, P2 and P3 in FIG. 8). Meanwhile, the positions of the intersection points P1, P2 and P3 shown in FIG. 8 are only for illustrative purposes, and the directions may intersect at positions other than the positions shown in the diagram.

The directions of high stretchability D1, D2 and D3 in the partitioned tightening portions 11*a*, 11*b* and 11*c*, respectively, are configured to follow, at the time of wearing, the muscle fiber direction of the gluteus medius muscles respectively covered by the partitioned tightening portions 11*a*, 11*b* and 11 *c*. As illustrated in FIG. 9, the gluteus medius muscle have different muscle fiber directions in the front part and the rear region. The partitioned tightening portions 11*a*, 11*b* and 11*c* of the first tightening portion 11 exhibit an effective supportive function even for the gluteus medius muscle having such unique muscle fiber directions.

In the exercise garment with a crotch part 1 of the present embodiment described above, the tightening portion 10 includes a pair of right and left first tightening portions 11 respectively covering an approximately triangular region formed by the upper part of the hip (near the position X), the lateral side of the lumbar region (near the position Y), and the vicinity of the position Z corresponding to the greater trochanter as the apex of the triangular region, respectively in the right and left sides of the wearer (see FIG. 5). The approximately triangular region formed by the upper part of the hip, the lateral side of the lumbar region, and the vicinity of the position Z corresponding to the greater trochanter as the apex of the triangular region, in each of the right and left sides of the wearer, corresponds to the position of the gluteus medius muscle of the wearer. This gluteus medius muscle is a fan-shaped muscle extending from the ilium to the greater trochanter, and constitutes the basis of the movement of hip joints. The first tightening portions 11 have plural partitioned tightening portions 11*a*, 11*b* and 11*c* extending in the vertical direction and adjoining in the width direction, and these partitioned tightening portions 11*a*, 11*b* and 11*c* are formed such that the respective directions of high stretchability thereof approach closer to one another toward the lower side. Therefore, at the time of wearing, the partitioned tightening portions 11*a*, 11*b* and 11*c* respectively cover the anterior side and the posterior side of the gluteus medius muscle. Furthermore, since the directions of high stretchability of the partitioned tightening portions 11*a*, 11*b* and 11*c* respectively follow the muscle fiber directions of the front part and the rear region of the gluteus medius muscle that forms a fan shape, the gluteus medius muscle can be reliably supported. As such, by reliably supporting the gluteus medius muscle that constitutes the basis of the movement of the hip joints, exercise of the legs in relation to the movement in a transverse direction or an oblique direction can be sufficiently supported.

Particularly, the exercise garment with a crotch part 1 is effective when a wearer performs an instantaneous or sudden movement while moving in a transverse direction or an oblique direction, such as a movement of suddenly stopping while moving in a transverse direction or an oblique direction, a movement of suddenly twisting the body, or a movement of suddenly starting to run. Such movements may frequently occur in, for example, sports games such as baseball, volleyball and basketball. When the wearer performs a highly instantaneous and sudden movement, there is a risk that a large strain may be imposed to the legs of the wearer. However, when the exercise garment with a crotch part 1 is used, the muscles for sustaining the body against an impact in a transverse direction or an oblique direction can be supported, and the strain imposed on the legs (for example, knees) of the wearer can be reduced. Thereby, the wearer can perform exercise without causing injuries.

Furthermore, in the waist portion 17, the width W1 of the front side region A1 in which the first tightening portion 11 is not formed is larger than the width W2 of the back side region A2 in which the first tightening portion 11 is not formed. Since the gluteus medius muscle is located closer to the posterior side than the lateral side of the body, the first tightening portion 11 is disposed at a position appropriate for supporting the gluteus medius muscle.

Furthermore, in the waist portion 17, since the width W1 of the front side region A1 in which the first tightening portion 11 is not formed is 2 times or more and 5 times or less the width W2 of the back side region A2 in which the first tightening portion 11 is not formed, the sense of pressure against the abdominal region is reduced.

The tightening portion 10 has a second tightening portion 12 (first line 12*a*) extending from the front part of the first tightening portion 11 to the inner side of a knee of the wearer via the anterior side of the femoral region of the wearer, and this second tightening portion 12 is disposed in a region corresponding to the sartorius muscle. Therefore, the tightening portion 10 can adequately support the legs in relation to the movement of suddenly stopping while moving in a transverse direction or an oblique direction, and thus, an impact exerted on the legs is reduced.

The tightening portion 10 has a third tightening portion 13 extending from the lower side of the first tightening portion 11 to the inner side of a knee of the wearer via the posterior side of the femoral region of the wearer, and this third tightening portion 13 is disposed in a region corresponding to the hamstrings. Therefore, the tightening portion 10 can adequately support the legs in relation to the movement of suddenly starting to run (for example, a movement at the time of abrupt start), and an impact exerted on the legs is alleviated.

Furthermore, since the second tightening portion 12 is joined to the front part of the first tightening portion 11, and the third tightening portion 13 is joined to the lower part of the first tightening portion 11, more suitable supporting of muscle activity is enabled by the cooperation of the first tightening portion 11 and the second tightening portion 12 or the third tightening portion 13 in accordance with the interlocking movement of the muscles.

Figure 10:
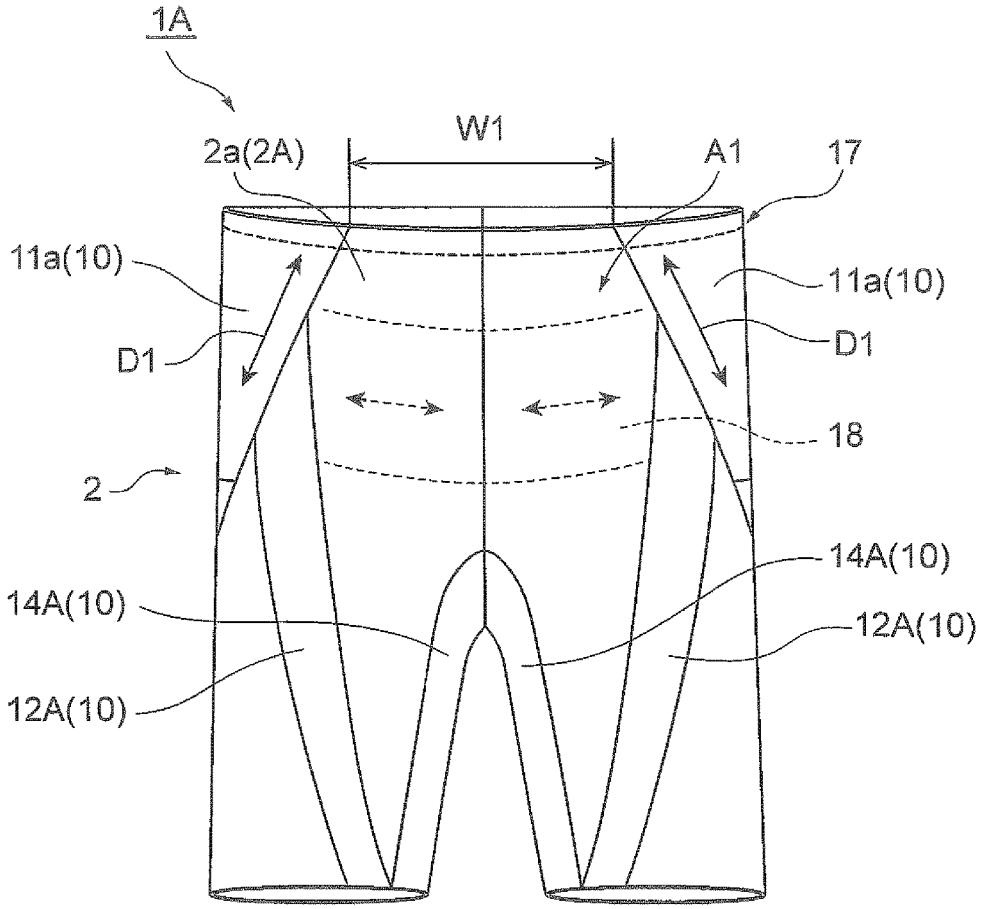
FIG. 10 is a front view diagram of the state in which an exercise garment with a crotch part according to a second embodiment is placed flat.
Figure 11:
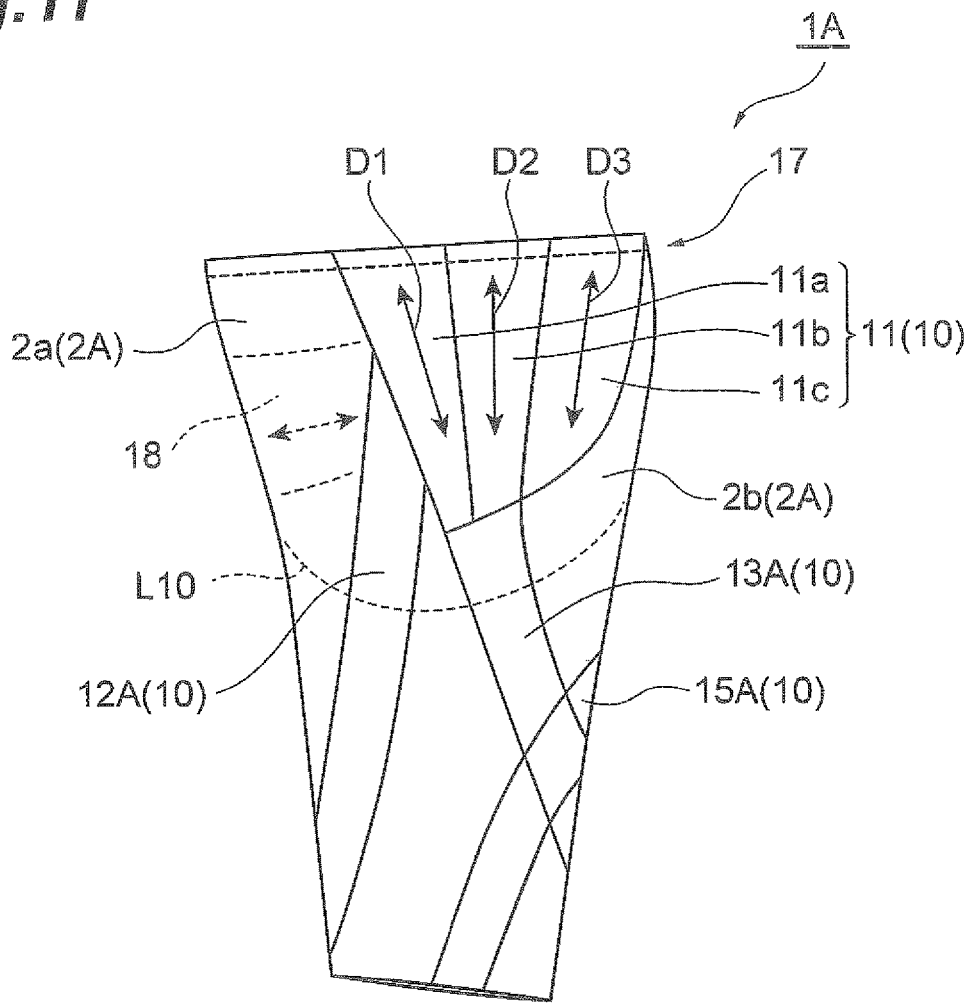
FIG. 11 is a diagram of the state in which the exercise garment with a crotch part illustrated in FIG. 10 is placed flat with the right side facing downward.

FIG. 10 is a front view diagram of a state in which the exercise garment with a crotch part 1A according to a second embodiment is placed flat, and FIG. 11 is a diagram of a state in which the exercise garment with a crotch part 1A is placed flat with the right side facing downward. A difference between the exercise garment with a crotch part 1A illustrated in FIG. 10 and FIG. 11 and the exercise garment with a crotch part 1 of the first embodiment illustrated in FIG. 1 to FIG. 8, is that the exercise garment with a crotch part 1A includes, instead of the main body portion 2, a main body portion 2A that sticks from the lumbar region of the wearer to the femoral region and ends over the knee of the wearer. This exercise garment with a crotch part 1A is a so-called half-type sport tights. In the exercise garment with a crotch part 1A, the second tightening portion 12A, the third tightening portion 13A, the fourth tightening portion 14A, and the fifth tightening portion 15A end over the knee. The fourth tightening portion 14A extends down to the hem regions along the adductor muscle and supports the adductor muscle.

This exercise garment with a crotch part 1A can also sufficiently support, similarly to the exercise garment with a crotch part 1, the exercise of the legs in relation to the movement in a transverse direction or an oblique direction by reliably supporting the gluteus medius muscle that constitutes the basis of the movement of the hip joints.

Figure 12:
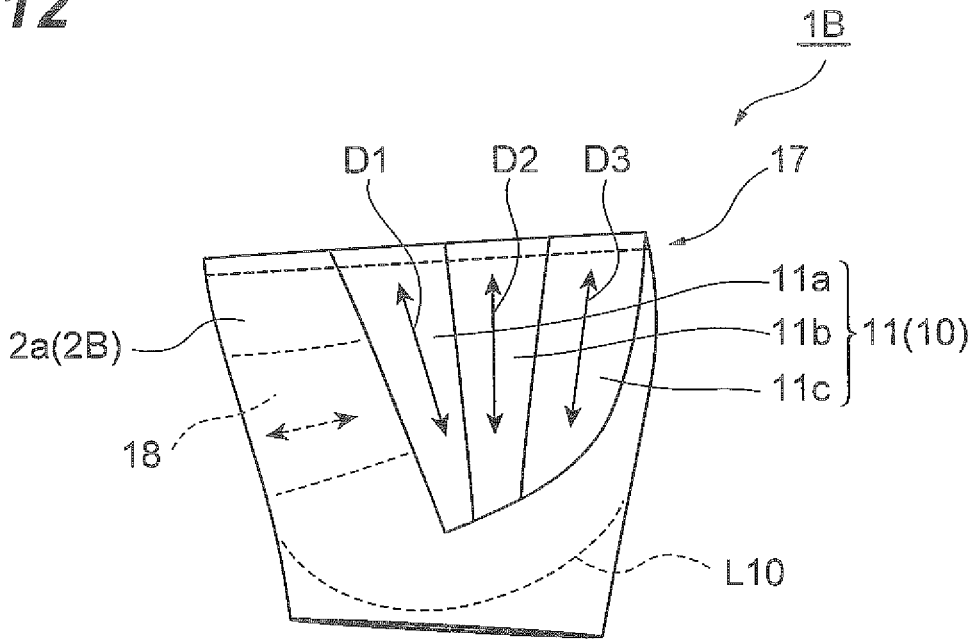
FIG. 12 is a diagram of the state in which an exercise garment with a crotch part according to a third embodiment is placed flat with the right side facing downward.

FIG. 12 is a diagram of the state in which the exercise garment with a crotch part 1B according to a third embodiment is placed flat with the right side facing downward. A difference between the exercise garment with a crotch part 1B illustrated in FIG. 12 and the exercise garment with a crotch part 1 of the first embodiment illustrated in FIG. 1 to FIG. 8, is that the exercise garment with a crotch part 1B includes, instead of the main body portion 2, a main body portion 2B sticking to the lumbar region of the wearer. This exercise garment with a crotch part 1B is a so-called short-type sport tights. In the exercise garment with a crotch part 1B, the second tightening portion, the third tightening portion, the fourth tightening portion, and the fifth tightening portion are not formed.

This exercise garment with a crotch part 1B can also sufficiently support, similarly to the exercise garment with a crotch part 1, the exercise of the legs in relation to the movement in a transverse direction or an oblique direction by reliably supporting the gluteus medius muscle that constitutes the basis of the movement of hip joints.

[Functional Test]

Figure 14:
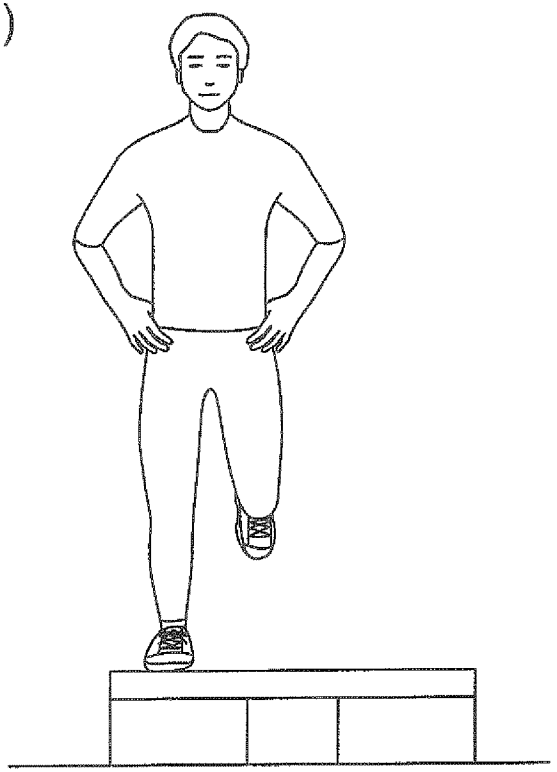
FIGS. 14(*a*) and 14(*b*) are explanatory diagrams for a method of performing a functional test for the tightening portions.
Figure 14:
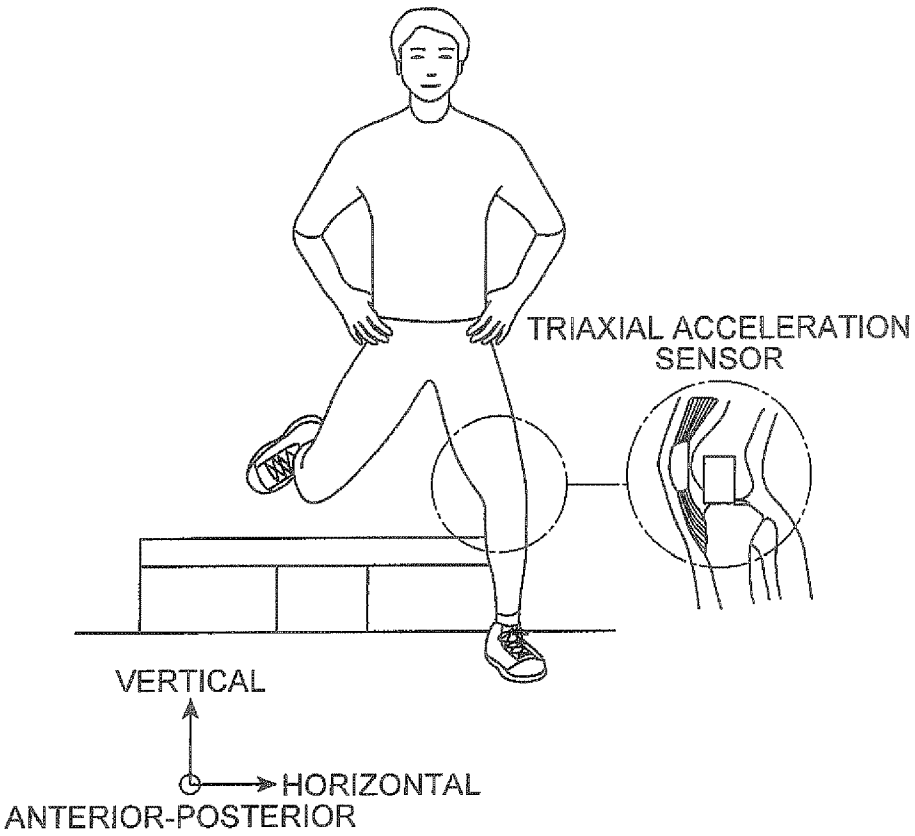

As illustrated in FIGS. 14(*a*) and 14(*b*), six monitors were allowed to perform a motion of jumping down diagonally forward from the top of a platform, and the acceleration in the downward direction and the acceleration in the inward direction imposed on the knees were measured using a triaxial acceleration sensor attached to an area corresponding to the lateral condyle of the femur of each monitor. The sampling frequency at the time of measurement was 2.56 kHz. It may be construed that the downward acceleration obtained by the measurement corresponded to the amount of load in the vertical direction, and the inward acceleration corresponding to the amount of load in the horizontal direction.

Figure 15:
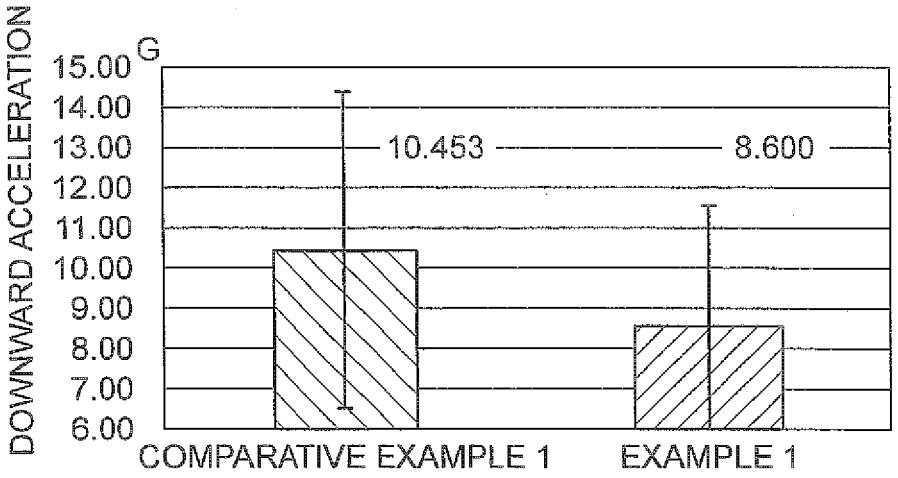
FIG. 15 is a diagram illustrating the results of a functional test concerning the load in the vertical direction imposed on the knee.
Figure 16:
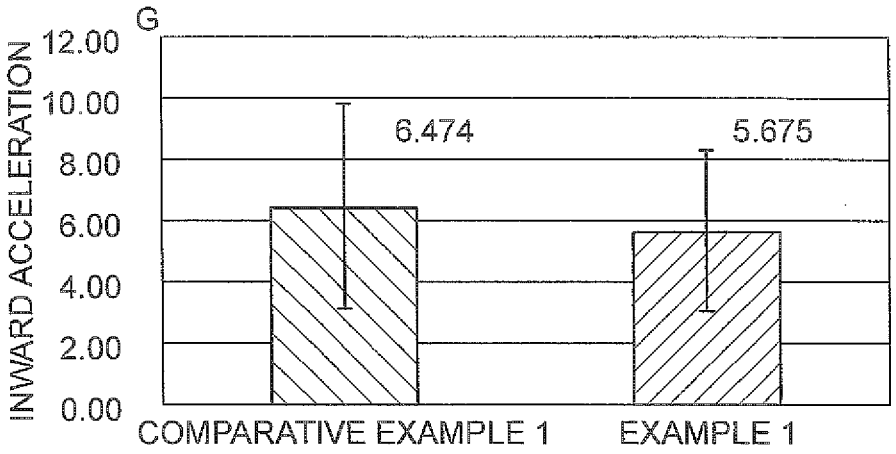
FIG. 16 is a diagram illustrating the results of a functional test concerning the load in the horizontal direction imposed on the knee.

As Example 1, the monitors were made to wear samples similar to the exercise garment with a crotch part 1. As Comparative Example 1, the monitors were made to wear samples in which tightening portions were not at all formed. FIG. 15 and FIG. 16 are diagrams presenting the test results. The number of data obtained was 17. As shown in FIG. 15, the average of the downward acceleration was 10.453 G in Comparative Example 1, while the average was 8.600 G in Example 1. As shown in FIG. 16, the average of the inward acceleration was 6.474 G in Comparative Example 1, while the average was 5.675 G in Example 1. From these results, it was confirmed that in Example 1 having tightening portions similar to those of the exercise garment with a crotch part 1, the loads imposed on the knees in both the vertical direction and the horizontal direction were reduced as compared with Comparative Example 1 having no tightening portions.

Figure 17:
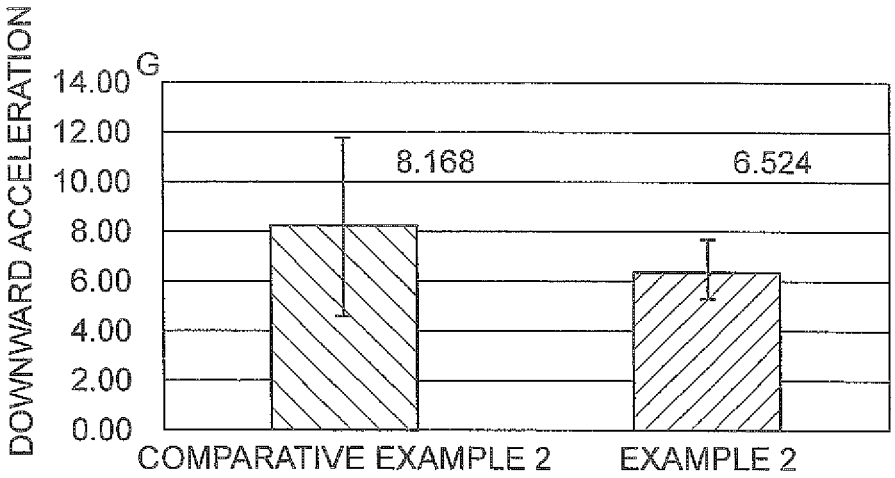
FIG. 17 is a diagram illustrating the results of a functional test concerning the load in the vertical direction imposed on the knee.
Figure 18:
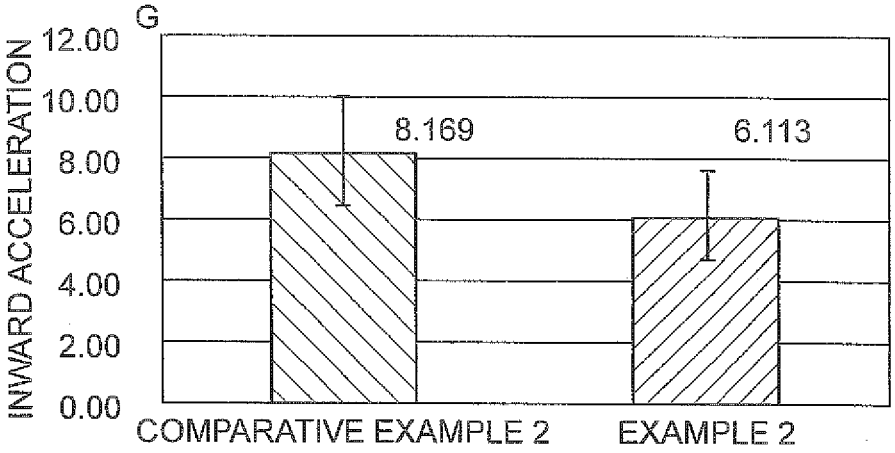
FIG. 18 is a diagram illustrating the results of a functional test concerning the load in the horizontal direction imposed on the knee.

Next, as Example 2, the monitors were made to wear samples similar to the exercise garment with a crotch part 1. As Comparative Example 2, the monitors were made to wear samples having tightening portions that covered the gluteus medius muscle but were not partitioned in the width direction. FIG. 17 and FIG. 18 are diagrams showing the test results. The number of data obtained was 6. As shown in FIG. 17, the average of the downward acceleration was 8.168 G in Comparative Example 2, while the average was 6.524 G in Example 2. As shown in FIG. 18, the average of the inward acceleration was 8.169 G in Comparative Example 2, while the average was 6.113 G in Example 1. From these results, it was confirmed that in Example 2 having tightening portions similar to those of the exercise garment with a crotch part 1, the loads imposed on the knees in both the vertical direction and the horizontal direction were reduced as compared with Comparative Example 2 having tightening portions that were not partitioned in the width direction.

Figure 13:
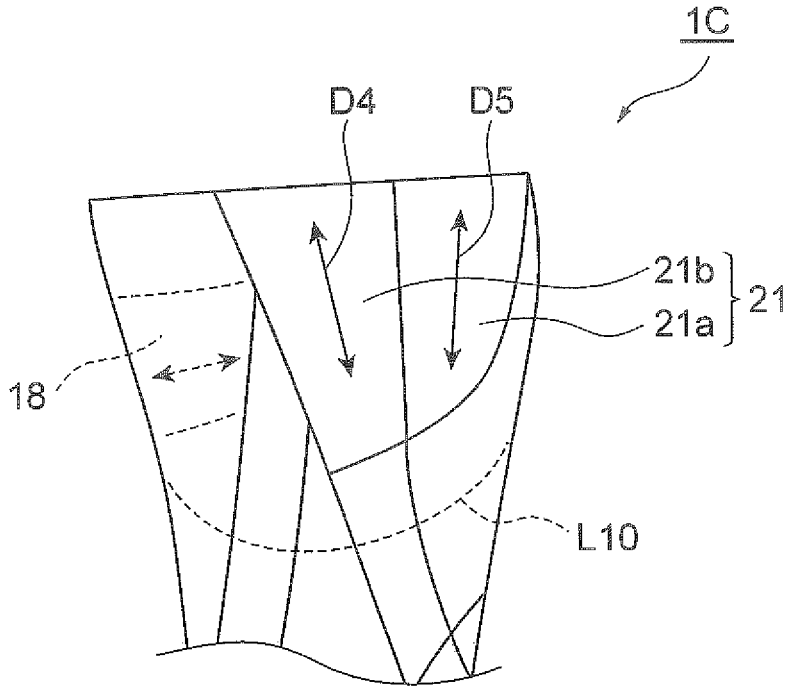
FIGS. 13(*a*) and 13(*b*) are diagrams of the state in which exercise garments with crotch parts according to modification examples are placed flat with the right sides facing downward.
Figure 13:
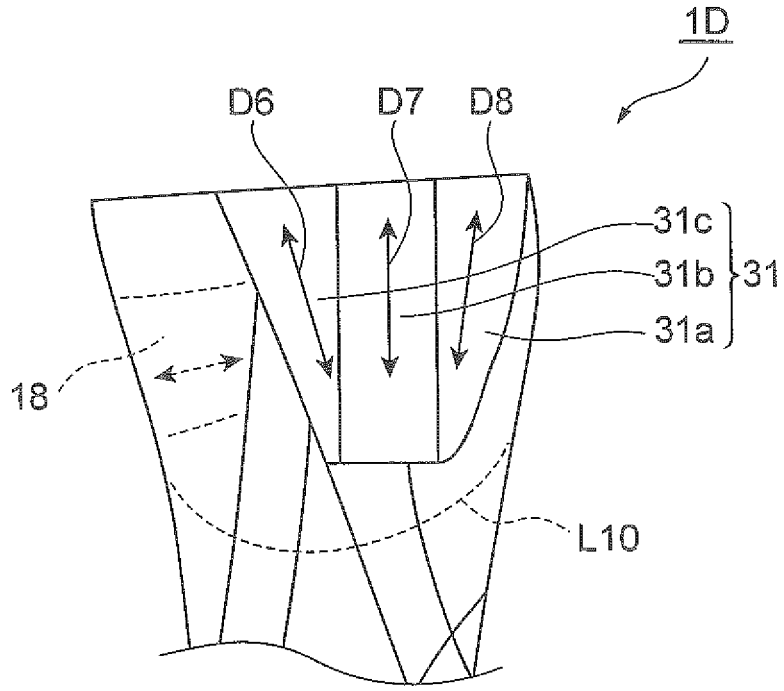

The present invention is not intended to be limited to the embodiments described above. For example, as illustrated in FIG. 13(*a*), an exercise garment with a crotch part 1C having a first tightening portion 21 that is bisected in the width direction and includes a partitioned tightening portion 21*a* and a partitioned tightening portion 21*b*, is also acceptable. In this case as well, since the directions of high stretchability D4 and D5 in the partitioned tightening portion 21*a* and the tightening portion 21*b*, respectively, are formed so as to approach closer to each other toward the lower side, the exercise garment with a crotch part can reliably support the gluteus medius muscle.

Furthermore, as illustrated in FIG. 13(*b*), an exercise garment with a crotch part 1D having a first tightening portion 31 that is trisected in the width direction and includes a partitioned tightening portion 31*a*, a partitioned tightening portion 31*b*, and a partitioned tightening portion 31*c*, in which any one partitioned tightening portion of the partitioned tightening portion 31*a*, the partitioned tightening portion 31*b* and the partitioned tightening portion 31*c* (in FIG. 13(*b*), the partitioned tightening portion 31*b* at the center) has a rectangular shape that is vertically long and tapering upward, is also acceptable. In this case as well, since the directions of high stretchability D6, D7 and D8 in the partitioned tightening portion 31*a*, the partitioned tightening portion 31*b*, and the partitioned tightening portion 31*c*, respectively, are formed so as to approach closer to one another toward the lower side, the exercise garment with a crotch part can reliably support the gluteus medius muscle.

It is desirable if a first tightening portion having partitioned tightening portions is formed, and the second tightening portion to the fifth tightening portion may be omitted. It is acceptable not to have a diamond-shaped hole 2*e* formed at a position corresponding to the kneecap. It is not limited to the case in which the various tightening portions are sewed up to the main body portion, and it is still acceptable to have the various tightening portions seamed to the front surface side or the back surface side of the main body portion, or it is acceptable to have the various tightening portions formed by resin printing. The various tightening portions may also be formed by etching processing (opal processing).

INDUSTRIAL APPLICABILITY

According to the present invention, the exercise of the legs in relation to the movement in a transverse direction or an oblique direction can be sufficiently supported.

REFERENCE SIGNS LIST

1, 1A, 1B, 1C, 1D EXERCISE GARMENT WITH A CROTCH PART
2 MAIN BODY PORTION
10 TIGHTENING PORTION
11 FIRST TIGHTENING PORTION
11*a* to 11*c* PARTITIONED TIGHTENING PORTION
12 SECOND TIGHTENING PORTION
13 THIRD TIGHTENING PORTION
17 WAIST PORTION
21 FIRST TIGHTENING PORTION
21*a*, 21*b* PARTITIONED TIGHTENING PORTION
31 FIRST TIGHTENING PORTION
31*a* to 31*c* PARTITIONED TIGHTENING PORTION
D1 to D8 DIRECTION OF HIGH STRETCHABILITY

The invention claimed is:

1. An exercise garment with a crotch part for covering at least a part of a lower body of a wearer, the lower body of the wearer having right and left sides, the exercise garment comprising:

a main body portion formed from a material having stretchability; a tightening portion having higher tightening force than the main body portion, wherein the tightening portion comprises a pair of right and left first tightening portions, each of the right and left first tightening portions consisting of three partitioned tightening portions adjoined by a seam line or seam lines, each of the right and left first tightening portions respectively adapted to fully cover an approximately triangular region formed by an upper part of a hip of the wearer, a lateral side of a lumbar region of the wearer, and a vicinity of a position corresponding to a greater trochanter of the wearer as an apex of the approximately triangular region, on the right and left sides of the wearer;

each of the three partitioned tightening portions extending in a vertical direction and adjoining in a width direction; and each of the three partitioned tightening portions being stretchable in a longitudinal direction and a transverse direction, and having a lower side and a direction of high stretchability, wherein stretchability in the longitudinal direction is greater than stretchability in the transverse direction or stretchability in the transverse direction is greater than stretchability in the longitudinal direction, and the direction of high stretchability is which of the longitudinal direction or the transverse direction having a greater stretchability, wherein the three partitioned tightening portions are formed such that the direction of high stretchability in each of the three partitioned tightening portions approaches closer to one another toward the lower side and each direction of high stretchability intersects one another below each of the right and left first tightening portions; and, a front side region, provided in a waist portion, in which the right and left first tightening portions are not formed;

a back side region, provided in the waist portion, in which the right and left first tightening portions are not formed; and wherein the tightening portion comprises a third tightening portion extending from a lower part of the right and left first tightening portions, wherein the third tightening portion is adapted to cover a posterior side of a femoral region of the wearer.

2. The exercise garment with a crotch part according to claim 1, wherein a width of the front side region is larger than a width of the back side region.

3. The exercise garment with a crotch part according to claim 2, wherein in the waist portion, the width of the front side region is 2 times or more and 5 times or less the width of the back side region.

4. The exercise garment with a crotch part according to claim 1, wherein the tightening portion comprises a second tightening portion extending from a front part of the right and left first tightening portions, wherein the second tightening portion is adapted to cover an inner side of a knee region of the wearer via an anterior side of a femoral region of the wearer.

5. The exercise garment with a crotch part according to claim 1, wherein each of the three partitioned tightening portions is oriented differently from one another in the vertical direction.

6. The exercise garment with a crotch part according to claim 4, wherein the third tightening portion is adapted to cover an inner side of a knee region of the wearer via a posterior side of a femoral region of the wearer; and a fourth tightening portion extending from a vicinity of a center of the crotch part, wherein the fourth tightening portion is adapted to extend from the vicinity of the center of the crotch part to a lower part along an adductor muscle of the wearer, and further extend to an outer side of the knee region of the wearer via an anterior side of the femoral region of the wearer.

7. The exercise garment with a crotch part according to claim 6, wherein the tightening portion further comprises a fifth tightening portion adapted to extend from the vicinity of the center of the crotch part to the outer side of the knee region of the wearer via the posterior side of the femoral region of the wearer and further extend to an inner side of a calf region of the wearer via an anterior side of a shin region of the wearer.

8. The exercise garment with a crotch part according to claim 1, wherein the third tightening portion extending from the lower part of the right and left first tightening portions has an upper end joined to the lower side of each of two of the three partitioned tightening portions of each of the right and left first tightening portions.

* * * * *